United States Patent [19]

Simon et al.

[11] 4,255,038

[45] Mar. 10, 1981

[54] HOLDER FOR PHOTOGRAPHIC PROCESSING MACHINES

[76] Inventors: Joachim Simon, Schillerstrasse 26, D-4006 Erkrath; Herman Held, Walstrasse 27, D-5439 Pottom; Wilhelm Stoye, Eschenweg 31, D-4000 Düsseldorf 30, all of Fed. Rep. of Germany

[21] Appl. No.: 31,398

[22] Filed: Apr. 19, 1979

Related U.S. Application Data

[63] Continuation of Ser. No. 831,433, Sep. 8, 1977, abandoned.

[30] Foreign Application Priority Data

Sep. 9, 1976 [DE] Fed. Rep. of Germany ..... 2640527

[51] Int. Cl.[3] ..... G03D 5/06

[52] U.S. Cl. ..... 354/318; 354/319; 134/122 P; 118/259; 29/113 R

[58] Field of Search ..... 354/317, 318, 319, 320, 354/321, 322; 118/259; 29/113 R, 117; 134/122 P, 64 P

[56] References Cited

U.S. PATENT DOCUMENTS

| | | | |
|---|---|---|---|
| 1,208,567 | 12/1916 | Johnston | 29/113 R |
| 1,297,809 | 3/1919 | Dixon | 29/113 R |
| 2,233,205 | 2/1941 | Frantz | 29/113 R |
| 3,000,287 | 9/1961 | Heldons | 29/113 R |
| 3,023,695 | 3/1962 | Kuster | 29/113 R |
| 3,170,382 | 2/1965 | Schwab et al. | 118/259 |
| 3,616,742 | 11/1971 | Boyle et al. | 354/319 X |
| 3,699,621 | 10/1972 | Clarke et al. | 29/113 R |
| 3,707,749 | 1/1973 | Henley | 29/113 R |

*Primary Examiner*—L. T. Hix
*Assistant Examiner*—Alan Mathews
*Attorney, Agent, or Firm*—Thomas J. Greer, Jr.

[57] ABSTRACT

A photographic processing machine has a plurality of rollers for transporting the photographic materials through a processing bath. According to this invention, alternate ones of adjacent rollers are provided with a flexible casing subject to internal hydraulic pressure. The flexible casing is formed of a textile fabric. The fabric encased rollers each have openings through their walls, the film treating bath liquid fed under pressure to the interior of each roller and then through the wall openings. The flexible textile casing thereby expands, to produce squeezing force on the photographic material being processed as the material passes between a rigid roller and its associated textile encased roller.

5 Claims, 3 Drawing Figures

HOLDER FOR PHOTOGRAPHIC PROCESSING MACHINES

This is a continuation of application Ser. No. 831,433 filed Sept. 8, 1977, now abandoned.

BACKGROUND OF THE INVENTION

Modern machines for developing photographic films or papers comprise several processing tanks arranged one behind the other. These tanks contain various processing baths through which the photographic paper or film to be developed is passed in succession. For this purpose, the papers or film is carried by holders or processing racks which may be suspended as desired and in any desired combination in the individual baths. A common drive for the holders or racks is provided at the side of each tank and the individual holders or racks are coupled to this drive when they are suspended in a tank, in order to start up the rollers thereof.

The known processing racks have rollers or cylinders for transporting the photographic material to be processed. These are arranged on horizontal axes one above the other. The present invention relates to a holder or rack in which the photographic material to be treated is passed between rollers arranged in a frame. The opposite rollers co-operate to transport and guide the photographic material, so that even relatively short films or strips of paper may be passed through the individual baths without difficulty. In order to achieve this, the co-operating surfaces of the rollers contact each other with a pressure.

In known holders for machines for developing photographs, the co-operating surfaces of the rollers are pressed against each other by one roller of each pair of rollers being adjustably mounted in relation to an opposing and fixed roller and being pressed against this fixed roller by means of springs. The fixed roller has a rigid surface, for example a steel casing, while the opposing roller is a resilient roller such as a rubber roller. An arrangement of this type has the disadvantage that the rollers of each pair of rollers are pressed against each other even when the machine is inoperative, so that pressure points may be produced on the elastic roller in the event of prolonged stationary periods. If photographic material to be developed runs through a pair of rollers of this type, then the adjustable roller lifts off the fixed roller, causing tilting if the photographic material passes between the pair of rollers on one side. Another disadvantage lies in the fact that particles of dirt which are deposited on the surface of one roller may also cause the rollers to move apart and cause scratches on the opposing roller and the passing photographic material. Finally, a uniform pressure between the co-operating rollers of a pair of rollers is only ensured if the rollers are mounted exactly parallel to each other and do not bend or sag.

An object of the present invention is to overcome these disadvantages and to provide a holder for machines for processing photographs in which the surfaces of the rollers contact each other and against the passing photographic material, with a pressure which is regulated automatically even during operation and which is uniform throughout, and which accordingly are not lifted apart when the photographic material or other irregularities pass through.

BRIEF SUMMARY OF THE INVENTION

The invention provides a holder for photographic processing machines comprising rollers, for transporting the photographic material through a processing bath, the said rollers being arranged one above the other with the surfaces of adjacent rollers pressed against each other, alternate ones of the adjacent rollers having a flexible casing subjected to internal hydraulic or pneumatic pressure.

The rollers without the flexible casings may each be a conventional roller having a smooth and solid, preferably rigid, surface such as for example a steel roller, a roller made of rigid plastics material or a roller with a rubberised surface. Each of the rollers having a flexible casing clings to the opposing roller or rollers and the passing photographic material so that a relatively large area of contact is produced between the co-operating rollers and the passing material. This is due to the fact that the flexible casings contact the more or less rigid opposing rollers with an arc of contact and with uniform pressure along its entire length, so that the irregularities of the rollers caused by their shape, impurities on their surfaces and by the photographic material passing between them are automatically compensated.

The internal pressure of the flexible casing of each roller is regulated so as to obtain the desired force of pressure and the desired arc of contact. In other words, the internal pressure is not so high as to obtain such an area of contact between this flexible casing and the respective opposing roller that the flexible casing clings to uneveness on the surface of the opposiing roller and impurities as well as the passing material.

The hydraulic pressure is preferably produced by the liquid in the bath in which the holder is suspended, and the flexible casings permeable to liquid. In this way, the liquid for the processing bath, is also transferred from the roller having a flexible surface to the photographic material to be treated. This has the further advantage of preventing problems of leakage on the roller since leakage of the means producing the hydraulic pressure cannot contaminate the bath and cannot affect the photographic material adversely. It is also possible to dispense with external means for producing the hydraulic pressure such as, for example, a separate supply of water or other hydraulic medium. Furthermore, the treatment of the passing photographic material is improved by supplying the liquid for the bath through individual rollers of the holder because bath liquid may be supplied to the photographic material even in those areas which are not situated below the surface of the liquid in the relevant plating tank. Moreover, the contact pressure of cooperating rollers only has to be produced and maintained when the holder is functioning and it is not necessary to mount the cooperating rollers adjustably against each other.

In a preferred embodiment of the invention, a tube provided with openings is arranged within each flexible casing. Both ends of this tube are preferably arranged on a hub mounted in the frame of the holder. The flexible casing is thus pulled over a more or less rigid core of the respective roller in the manner of a tube or stocking and surrounds this core at a distance which depends upon the pressure prevailing within the roller and the counter-pressure produced externally on the roller, or rests on the external side of the tube. Thus, the casing is not a load-bearing component, but merely determines the external shape of the roller through whose rigid core the hydraulic medium is supplied. The rigid core serves as a mounting, in which each hub has a bearing journal fixed in the frame of the holder and a stopper rotatably mounted thereon and projecting into the respective end of the tube. This allows the respective roller to be assembled and the stocking-shaped or tube-like flexible casing to be applied in such a way that it is simple to construct and also to exchange worn parts. The ends of the tube-like flexible casing are folded inwards over the ends of the tube and are then clamped between the respective end of the tube and the rotatably mounted plug, for example by means of a screw-threaded connection.

One of the two bearing journals is preferably provided with an axial passage, in which case a pressure pipe for liquid for the bath is connected to the external end of this passage. Bath liquid is fed from the respective plating tank through this pipe and introduced into the roller under the desired pressure. This also produces a specific circulation of the bath liquid so that a conventional circulation pump may be used for creating the required pressure.

The flexible casing of one of the rollers is preferably made of textile fabric, in which case the fabric may be a close-meshed pile material, the pile of which forms the external side of the casing. This design has the advantage of the surface of the photographic material, which comes into contact with this roller and which is generally to be the coated surface, being treated very carefully, thus preventing scratches from forming on the coated surface. Particles of dirt which may pass between the rollers disappear in the pile cover of the flexible casing on one roller and therefore become harmless. The nap of the pile material forming the external side of the casing also ensures that the liquid supplied through the rollers is distributed uniformly and that the casing contacts the passing photographic material and the opposing roller uniformly, thus constantly automatically compensating the irregularities caused by inaccurate roller mounting, inaccuracies of the rollers themselves and of the passing photographic material.

DESCRIPTION OF A PREFERRED EMBODIMENT

Figure 1:
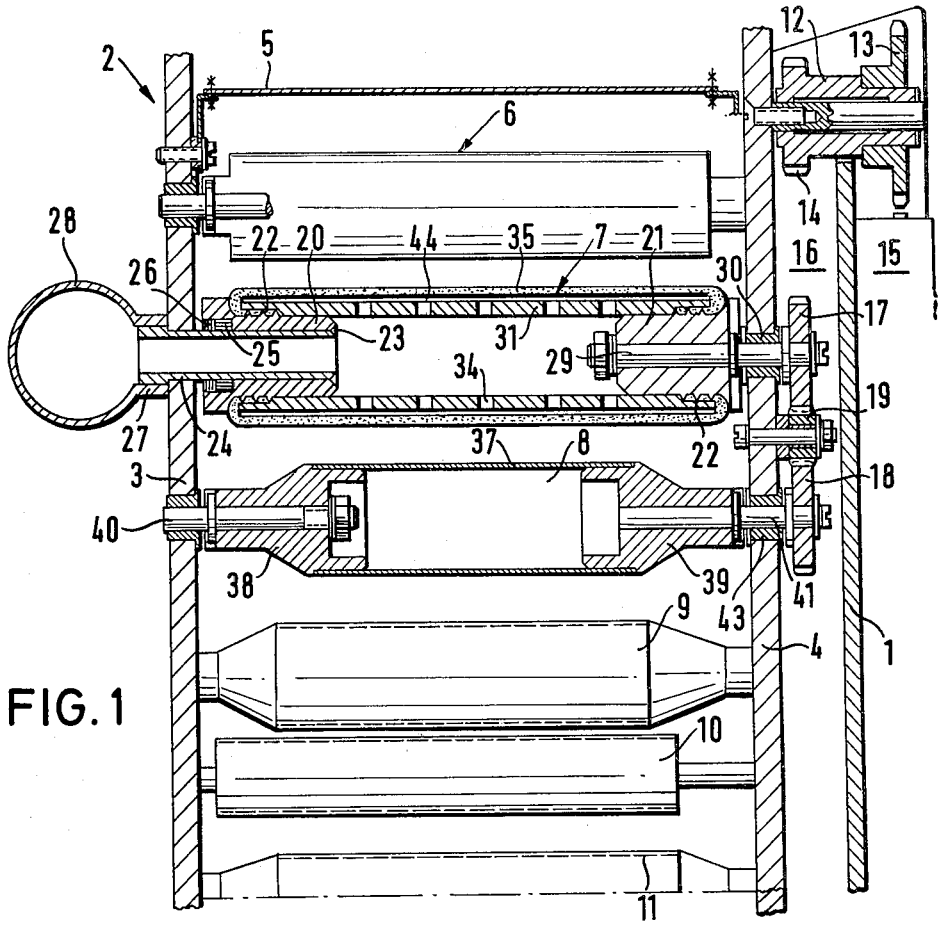
FIG. 1 is a section of a holder viewed from the front and showing a roller having a flexible casing.

FIG. 1 illustrates a processing tank 1, in which a holder 2 is suspended. This holder 2 has a frame consisting of two side plates 3 and 4 connected by ties 5. Several rollers 6 to 11 are rotatably mounted in the frame one above the other. Only some of these rollers are illustrated in order to simplify the illustration.

A drive gear 12 is rotatably mounted externally at the upper end of one of the plates 4. This gear includes a chain wheel 13 on the outer end and a toothed wheel 14 on the inner end. The chain wheel 13 engages in a drive chain (not shown in detail), fed via a projection 15, when the holder 2 is suspended in the plating tank 1 in the position shown.

Toothed gearing 16 is arranged between the toothed wheel 14 and the individual driven rollers. Toothed wheels 17 and 18 are fixed to the rollers 7 and 8 respectively and are connected together as a gear train through an intermediate pinion 19. The remaining rollers which are only schematically illustrated are also connected to the gear 16 in the same way. Alternately, it is also feasible, for example, to provide a chain drive or a similar gear mechanism for driving the rollers instead of a toothed gear.

The roller 7 is composed of several parts and comprises two hubs 20 and 21 which are each provided with an external screw thread 22. The hub 20 has a central passage 23 which receives a tube 24 which extends through the side plate 3 and is fixed therein. the hub 20 is rotatably mounted on the tube 24 by means of a bearing 25 to which is attached a gasket 26.

A connecting piece 27 for a pressure pipe 28 is fitted on the external end of the tube 24. The pressure pipe 28 supplies bath liquid under pressure and has identical attachments for all of the other rollers which are constructed as the roller 7.

The hub 21 is fixed on the end of a shaft 29 which is rotatably mounted in a bush 30 in the side plate 4. The toothed wheel 17 is fixed on the external end of the shaft 29 so that the roller 7 is driven through the hub 21.

A rigid tube 31 consisting of a material such as plastics is screwed on the two hubs 20 and 21. This tube 31 has an extension 32 at each end. Button-like projections 33 are provided on the internal face of the extension to co-operate with the screw thread 22 on the two hubs 20 and 21. The tube 31 has passages 34 distributed over its circumference and its length, through which liquid may flow outwards from the interior of the tube.

A tube-like or stocking-shaped cover 35 made of textile fabric such as a pile material is arranged on the tube 31 with the pile cover pointing outwards. The ends 36 of this cover 35 are directed inwards over the two extensions 32 of the tube 31, (as shown in FIG. 2), so as to be clamped and secured between the tube and the respective hub when the tube 31 is screwed on the hubs 20 and 21.

A rigid roller 8 is arranged opposite the roller 7, in fact, preferably on both sides of the roller 7. This rigid roller 8 includes of a rigid tube 37 of a material such as stainless steel, plastics or steel with a rubberised surface. Each parts 38 and 39 are fixed on the ends of the tube. The parts 38 and 39 contain axle journals 40 and 41 respectively which are rotatably mounted in sleeves 42 and 43 respectively in the side walls 3 and 4 respectively. The journal 41 supports an external toothed drive wheel 18.

Figure 2:
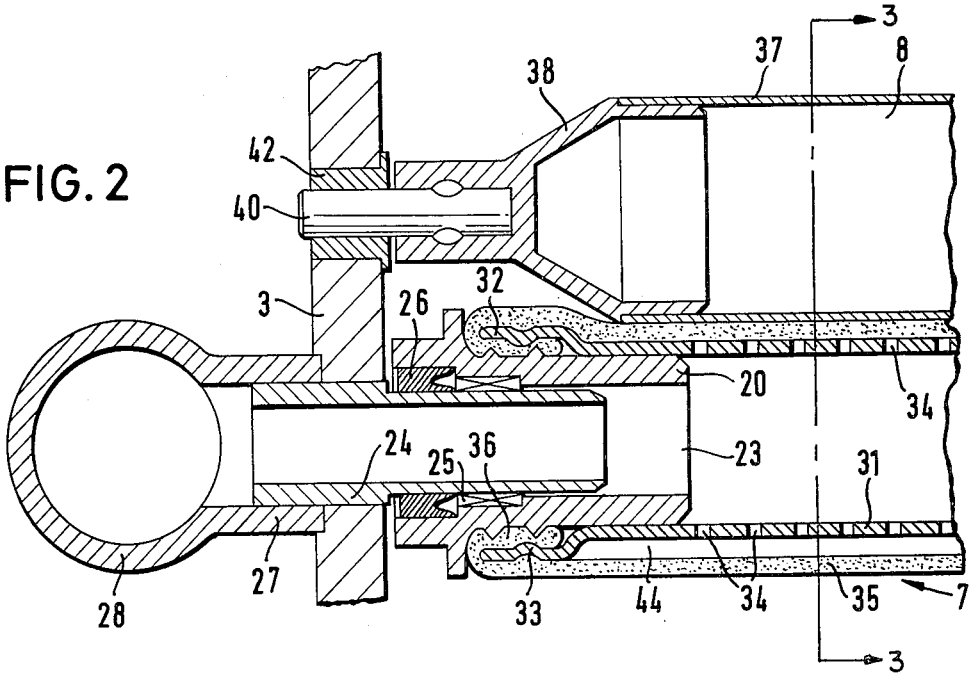
FIG. 2 is a section of part of the holder illustrated in FIG. 1, showing details of the roller provided with the flexible casing, the mounting thereof and the contact thereof with a rigid opposing roller.
Figure 3:
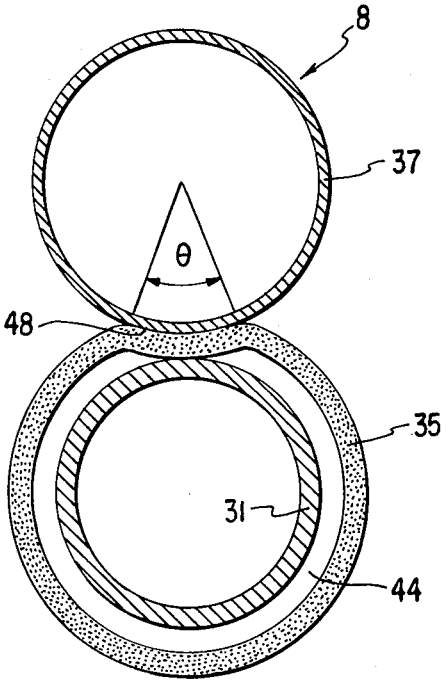
FIG. 3 is a view taken along line 3—3 of FIG. 2.

The rollers 7 and 8 are parallel to each other and are arranged to produce a contact pressure which causes the cover 35 of the roller 7 to be pressed in contact with the roller 8, as shown in FIG. 2. The cover 35 of the roller 7 therefore lies against the surface of the roller 8 forming an arc of contact, causing the film material (not shown in detail) which is to be conveyed between these rollers to be well carried without being subjected to excessive stress. In the loaded condition, the cover 35 is pressed towards the outer surface of tube 31 by roller 8, as shown in the upper part of FIG. 2. In the unloaded condition, the cover 35 is spaced at a distance from the tube 31, as shown in the lower part of FIG. 2, particularly when a hydraulic medium such as bath liquid is introduced into the interior of the tube 31 through the pressure pipe 28. This bath liquid penetrates the holes 34 almost unobstructed, while a greater resistance opposes passage through the fabric of the cover 35. For this reason, the liquid in the space 44 between the cover 35 and the tube 31 is uniformly distributed and thus exerts a uniform pressure on the internal side of the cover 35 and also flows out of this space uniformly through the surface of this cover. As shown at FIG. 3, the said arc of contact extends over an angle theta, to thereby define a surface of contact 48 between cover 35 and roller 8.

When the cover 35 wears out or if this cover is to be replaced by a cover of another shape, it is only necessary to unscrew the tube 31 from the hubs 20 and 21 and to exchange the cover, whereupon the tube is screwed up again. The roller 7 is then ready for operation once again. Repairs of this type may therefore be carried out very inexpensively.

What is claimed is:

1. A holder for transporting photographic material through a processing bath of a photographic processing machine, comprising at least one pair of rollers rotatably arranged within a common frame with the surfaces of adjacent rollers pressed against each other, alternate ones of each pair of adjacent rollers having a rigid internal tube provided with radial openings along its length, the rigid internal tube carrying thereover and therealong a hoselike flexible cover, the flexible cover being permeable to the liquid in the processing bath, means for conducting liquid in the processing bath to the interior of the rigid roller having the flexible cover, said flexible cover being thereby subjected internally to hydraulic pressure, said flexible cover in its unloaded condition being spaced from the rigid internal tube which it surrounds due to said hydraulic pressure the cover having a smaller radial dimension in its loaded condition where it contacts the other, rigid, roller of each said pair of adjacent rollers, said contact defining a surface of contact, over an arc, along a portion of said flexible cover and along a portion of the other, rigid roller, whereby photographic material passing between said pair of rollers is contacted by the liquid in the processing bath over an arcuate surface of contact, and whereby the hydraulic pressure may be regulated to obtain the desired force along the arcuate surface of contact and the desired arc of contact.

2. A holder according to claim 1, wherein both ends of each internal tube are arranged to fit over a hub mounted in the common frame, each hub being provided with an external screw thread and screwed into the respective end of the internal tube, each end of said hoselike cover being folded around the ends of said internal tube, the fold extending between the said threads on the hubs and within the respective ends of said internal tube, thus firmly securing the cover to said tube.

3. A holder according to claim 2, wherein one of the two hubs has an axial passage, the external end of which is connected to a pressure pipe in communication with liquid taken from the processing bath.

4. A holder according to claim 2, wherein the cover comprises a textile fabric.

5. A holder according to claim 4, wherein the fabric is a pile material with a narrow-meshed woven substrate, the pile of which forms the external side of the flexible cover.

* * * * *